US005738068A

United States Patent [19]

Fujishita et al.

[11] Patent Number: 5,738,068

[45] Date of Patent: Apr. 14, 1998

[54] METHOD AND APPARATUS FOR CONTROLLING INTERNAL COMBUSTION ENGINE FOR AUTOMOTIVE VEHICLE

[75] Inventors: Masakatsu Fujishita, Mito; Shoji Sasaki, Hitachinaka; Masaru Shibano, Hitachinaka; Yoshihiko Akagi, Hitachinaka, all of Japan

[73] Assignees: Hitachi, Ltd.; Hitachi Car Engineering Co., Ltd., both of Japan

[21] Appl. No.: 860,018

[22] PCT Filed: Oct. 17, 1996

[86] PCT No.: PCT/JP96/03010

§ 371 Date: Jun. 20, 1997

§ 102(e) Date: Jun. 20, 1997

[87] PCT Pub. No.: WO97/14878

PCT Pub. Date: Apr. 24, 1997

[30] Foreign Application Priority Data

Oct. 20, 1995 [JP] Japan ..... 7-272291

[51] Int. Cl.[6] ..... F02M 3/00

[52] U.S. Cl. ..... 123/339.14

[58] Field of Search ..... 123/339.14, 424, 123/422, 494, 492, 478; 364/431.07, 431.03

[56] References Cited

U.S. PATENT DOCUMENTS

| | | | |
|---|---|---|---|
| 4,366,541 | 12/1982 | Mouri et al. | 364/431.05 |
| 4,903,657 | 2/1990 | Miyazaki et al. | 123/339.14 |
| 4,903,660 | 2/1990 | Sogawa | 123/339.14 |
| 5,025,197 | 6/1991 | Nakamura | 123/339.14 |
| 5,345,908 | 9/1994 | Nishimura et al. | 123/339.14 |

FOREIGN PATENT DOCUMENTS

| | | | |
|---|---|---|---|
| 1-39306 | of 0000 | Japan | 123/339.14 |
| 59-49351 | 9/1982 | Japan . | |
| 64-73150 | 9/1987 | Japan . | |
| 1-227846 | 3/1988 | Japan . | |
| 63-57616 | 11/1988 | Japan . | |

*Primary Examiner*—Raymond A. Nelli

*Attorney, Agent, or Firm*—Evenson, McKeown, Edwards & Lenahan, P.L.L.C.

[57] ABSTRACT

An apparatus for controlling an internal combustion engine for a vehicle includes a driving condition detecting unit (1–13, 50, 72) detecting a driving condition of the internal combustion engine and outputting a driving condition value indicative of the driving condition, and a control unit (71). The control portion has an input circuit (116, 113, 119) inputting a driving condition value from the driving condition detecting unit, detecting the driving condition value and outputting as the driving condition detection value, a reference power source circuit (70) generating a reference voltage (Vcc) for operating the control apparatus (FIG. 2) on the basis of a battery voltage from a battery (50), and a unit (CPU 100) controlling the internal combustion engine on the basis of the driving condition detected value from the input circuit.

20 Claims, 8 Drawing Sheets

METHOD AND APPARATUS FOR CONTROLLING INTERNAL COMBUSTION ENGINE FOR AUTOMOTIVE VEHICLE

TECHNICAL FIELD

The present invention relates to a method and an apparatus for controlling an internal combustion engine for an automotive vehicle. More particularly, the invention relates to a method and apparatus for controlling an internal combustion engine for an automotive vehicle, which can detect driving condition of the internal combustion engine with small fluctuation per vehicle, at high accuracy and low cost.

BACKGROUND ART

Conventionally, in a control apparatus of an internal combustion engine mounted on an automotive vehicle, as sensors for detecting driving condition, such as an intake air flow rate, a coolant temperature, a throttle valve angular position and the like of the internal combustion engine, an air flow sensor, a coolant temperature sensor, a throttle angle sensor and the like are provided, respectively. Outputs of these sensors are input to an input circuit and converted into a digital data by an analog/digital (A/D) converter in the input circuit, and subsequently, arithmetically processed by a microcomputer. On the basis of results of process, actuators, such as a fuel injection device, a spark ignition device and the like are controlled. In a control unit, a reference power source circuit which generates a reference voltage to be supplied to the control unit on the basis of a battery voltage from a battery mounted on the vehicle, that is, a vehiclar battery, is provided.

On the other hand, the reference power source circuit is designed to generate a constant voltage irrespective of fluctuation of the battery voltage. However, the reference voltage generated by the reference power source circuit fluctuates per control units due to fluctuation of values of circuit elements (e.g., resistance value, a value of capacitor and the like) forming the reference power source circuit per the control units. When the reference voltage to be generated by the reference power source circuit fluctuates per control unit, the output values of the sensors and output values of the A/D converter also fluctuate per the control unit. The fluctuation of the output values of the A/D converter due to fluctuation of the circuit elements of the reference power source circuit is about ±5%.

On the other hand, due to the fluctuation of the values of the circuit elements forming the A/D converter in the input circuit, the output value of the A/D converter also fluctuates per the control unit. The fluctuation of the output value of the A/D converter due to fluctuation of the circuit elements of the A/D converter is about ±0.05%.

An output voltage of the vehicular battery is applied to the A/D converter after voltage division by a divider circuit in the input circuit, to detect an output voltage. In this case, since the values of the circuit elements (e.g. resistor and the like) forming the divider circuit fluctuate per control unit, the output value of the divider circuit also fluctuates per control unit. The fluctuation of the output value of the A/D converter due to fluctuation of the circuit element of the divider circuit is about ±1%.

In order to avoid fluctuation of the circuit element, it becomes possible to enhance precision of the values of respective circuit elements by employing a method, such as a laser trimming and the like. In this case, a problem is encountered to rise a cost.

On the other hand, conventionally, an alternator for a vehicle, which is driven and rotated by the internal combustion engine of the automotive vehicle to perform power generating operation, has been controlled typically by a control unit called in general as an IC regulator. The IC regulator controls an output of the alternator at a predetermined level while detecting the voltage of the vehicular battery which is charged by the output of the alternator.

According to JP-B-1-39306 (Publication (1)), there is shown a system in which an amount of current flowing through an exciting coil of the generator is controlled depending upon driving condition by applying a control signal of a microcomputer to a switching means incorporated in the generator via a signal line to thereby control ON and OFF operation of the switching means.

In the control unit of the vehicular generator disclosed in the foregoing publication (1), there are little proposal for improvement in generation voltage of the generator and control precision of the generation voltage. In general, fluctuation of the circuit element of the portion generating the reference voltage in the IC regulator can be eliminated by employing a method for the laser trimming or the like. In such a case, a problem is encountered to make the cost high.

Thus, there is no system to achieve both the improvement of precision of output of the A/D converter serving as the detection value of the driving condition and the low cost of the control unit.

DISCLOSURE OF INVENTION

Accordingly, it is an object of the present invention to provide a method and an apparatus for controlling an internal combustion engine for an automotive vehicle, which can detected a driving condition of the internal combustion engine with small fluctuation per vehicle, high precision and low cost.

In order to accomplish such an object, according to one aspect of the invention, an apparatus for controlling an internal combustion engine for a vehicle comprises: a driving condition detecting unit for detecting a driving condition of the internal combustion engine and outputting a driving condition value indicative of the driving condition; an input circuit inputting a driving condition value from the driving condition value from the driving condition detecting unit, detecting the driving condition value and outputting as a driving condition detection value; a reference power source circuit generating a reference voltage for operating the control apparatus on the basis of a battery voltage from a battery; a memory unit for storing a correction data for correcting an error of the driving condition detected value detected by the input circuit caused by at least one of an error of the reference voltage from the reference power source circuit and an error of the output of the input circuit; a correcting unit for correcting the driving condition detected value from the input circuit with the correction data stored in the memory unit to obtain a correct driving condition detected value; and a unit for controlling the internal combustion engine on the basis of the correct driving condition detected value thus obtained.

In one example of the present invention, the driving condition detecting unit, the input circuit, the reference power source circuit, the unit for controlling the internal combustion engine and the unit for deriving the correction data are provided in a control unit of the controlapparatus. The correction data is derived and stored in the memory before installation of the control unit on the vehicle. Subsequently, the control unit storing the correction data in the memory thereof is installed in the control apparatus.

According to one example, a driving condition detected value output from the input circuit by applying a reference value of the driving condition to the input circuit is compared with the reference value of the driving condition, and the correction data is derived on the basis of the result of comparison. Here, the reference value of the driving condition indicates the driving condition detected value detected by the input circuit by applying the reference value of the driving condition to the input circuit at least when no error is contained in the reference voltage from the reference power source circuit for example.

According to one example of the invention, the input circuit includes a voltage dividing circuit dividing the driving condition value from the driving condition detecting unit at a predetermined ratio and an analog/digital converter converting the dividing condition value from the voltge dividing circuit into a digital value.

According to one example of the invention, the unit for deriving the correction value obtains the ratio between the driving condition detected value output from the input circuit and the predetermined reference driving condition detected value, as the correction data. In this case, the correction unit obtains the correct driving condition detected value by multiplying the driving condition detected value from the input circuit by the correction data stored in the memory.

According to one example of the invention, the unit for deriving the correction data stores the driving condition detected value output from the input circuit in the memory as an intermediate parameter of the correction data before installation of the control unit on the vehicle, and derives the correction data from the intermediate parameter stored in the memory and the predetermined reference driving condition detected value, after installation of the control unit on the vehicle.

According to one example of the invention, as the above-mentioned memory, the memory to be electrically written-in, such as P-ROM, EEP-ROM, flush memory and like, is employed.

According to the present invention, since the output (driving condition detected value) from the input circuit is corrected using the correction data which is derived in advance per the control apparatus of the internal combustion engine, the error of the output value (detected value of the driving condition) of the input circuit due to fluctuation of respective circuit elements of the reference power source circuit and the input circuit (voltage divider, A/D converter) can be corrected per the control apparatus of the internal combustion engine. Accordingly, it becomes possible to control the internal combustion engine on the basis of correct A/D converted value of the driving condition value, such as the sensor output, the battery voltage and so forth. Furthermore, since the generation voltage of the alternator as one kind of the driving condition can be detected with higher precision, the generation voltage of the alternator can be controlled with high precision to permit higher precision control of the generation voltage and following ability of the generation amount depending upon the driving condition of the internal combustion engine and the electric load condition. Furthermore, it becomes possible to improve driving performance of the internal combustion engine and to reduce fuel consumption. Furthermore, it becomes possible to improve control precision of the internal combustion engine for preventing fluctuation of revolution during an idling condition. In the present invention, error of the output value of the input circuit due to fluctuation of respective circuit elements of the reference power source circuit and the input circuit (voltage divider and A/D converter) per the control apparatus of the internal combustion engine in not corrected by enhancing precision of the values of the circuit elements using the method of laser trimming or so forth as in the prior art. Namely, in the present invention, the error of the output value of the input circuit is corrected using the correction data preliminarily derived per the control apparatus of the internal combustion engine and stored in the memory. Therefore, the output value of the input circuit can be detected with high precision at low cost.

Furthermore, in the present invention, the driving condition detecting unit, the input circuit, the reference power source circuit, the unit for controlling the internal combustion engine and the unit for deriving the correction data are provided in the control unit of the control apparatus, then the correction data is derived and stored in the memory before the control unit is installed in the control apparatus, namely before mounting on the vehicle. Subsequently, the control unit storing the correction data in the memory thereof is installed in the control apparatus.

Namely, in the factory manufacturing the control unit, after assembling of the control unit, the correction data may be derived per the control unit to store in the memory of the control unit. Thereafter, the control unit may be shipped. The control unit may be subsequently installed in the control apparatus, namely on the vehicle. Thus, upon shipping of the control unit, the error specific to respective control unit can be corrected per the control unit.

BEST MODE FOR CARRYING OUT THE INVENTION

One embodiment of a method and an apparatus for controlling an internal combustion engine for an automotive vehicle according to the present invention will be discussed hereinafter in detail with reference to the accompanying drawings.

Figure 1:
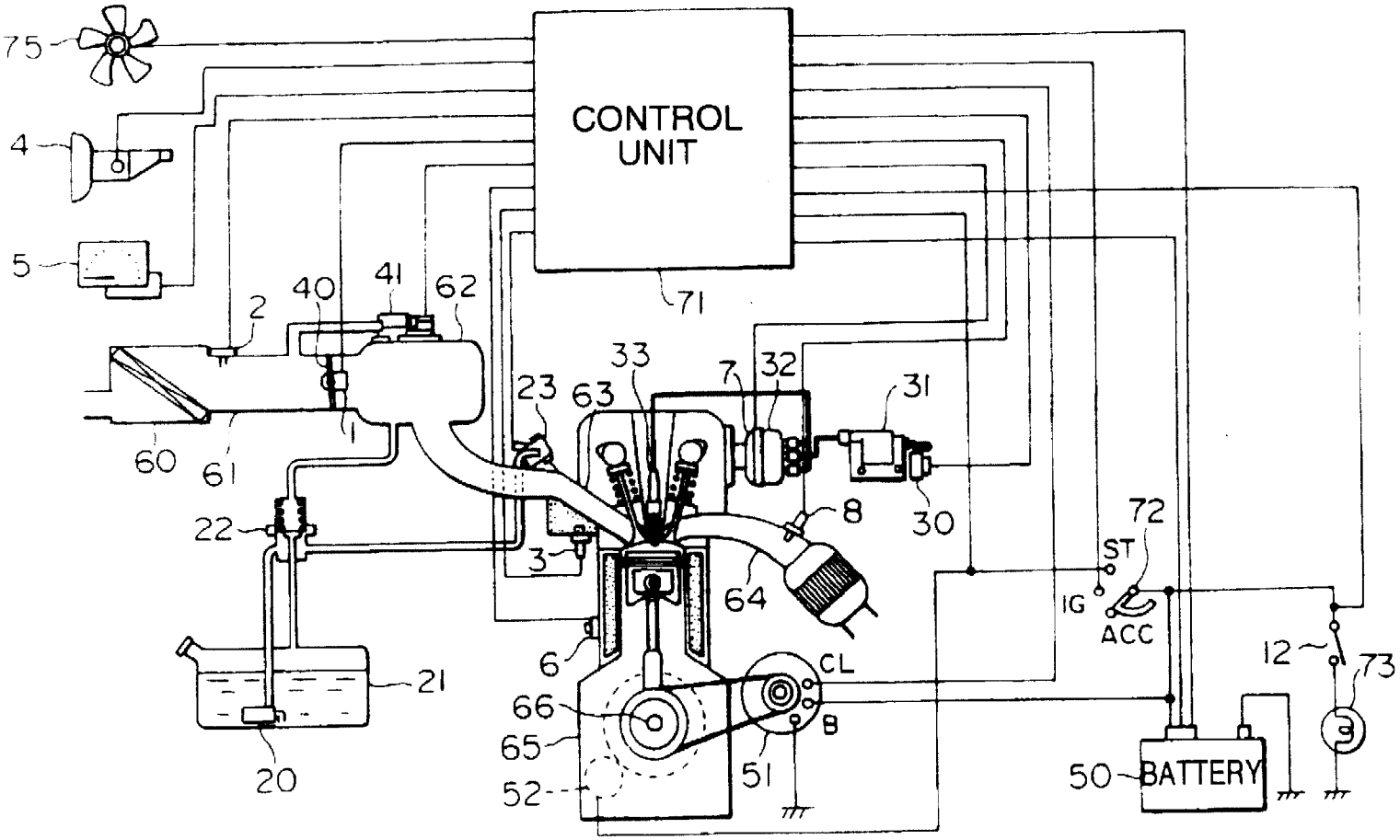
FIG. 1 is an illustration showing one example of the overall construction of a control system of an internal combustion engine of an automotive vehicle, to which the present invention is applied.
Figure 2:
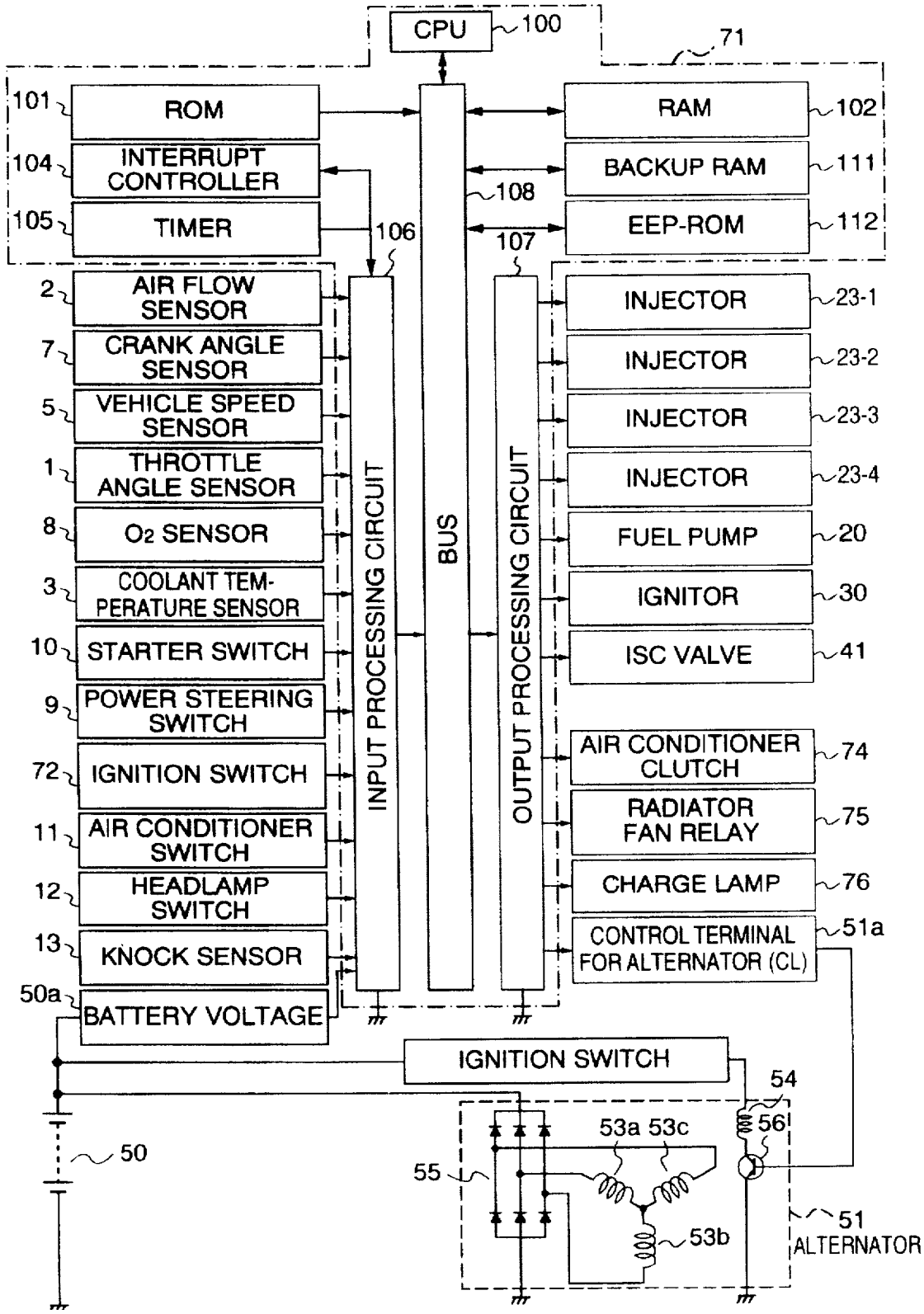
FIG. 2 is a block diagram showing a construction of one embodiment of a control apparatus of an internal combustion engine for an automotive vehicle according to the present invention.

FIG. 1 is an illustration showing one example of the overall construction of a control system for the internal combustion engine for the automotive vehicle, to which the present invention is applied. FIG. 2 is a block diagram showing a construction of one embodiment of a control apparatus for the automotive internal combustion engine according to the present invention.

In FIG. 1, an internal combustion engine 65 which is mounted on a vehicle, such as an automotive vehicle, for example, has an output shaft outputting a rotational torque, i.e. a crankshaft 66. The crankshaft 66 is mechanically coupled with a vehicular alternator 51 via a pulley and a belt.

On the other hand, the internal combustion engine 65 transmits its rotational torque to a driving wheels via a transmission as in the general vehicle.

As one example shown in FIG. 1, a so-called MPI (multi-cylinder fuel injection) type four-cylinder internal combustion engine will be explained.

Air is guided to an air flow meter 2 provided at the outlet portion of an air cleaner 60. As the air flow meter 2, a hot-wire type air flow sensor is employed. The air enters into a collector 62 via a duct 61 connected to the air clearer, a throttle body including a throttle valve 40 associated with an accelerator pedal operated by a driver and controlling an air flow rate, and an ISC (idle speed control) valve 41 provided bypassing the throttle body and controlling an idling speed. Here, the air is distributed to respective intake manifold 63 directly connected to the engine and then sucked into cylinders.

A fuel is sucked from a fuel tank 21 by a fuel pump 20, pressurized, regulated at a constant pressure by a pressure regulator 22 and injected into the intake manifold through injectors 23 provided in the intake manifold 63.

From an air flow meter 2, a signal corresponding to an intake air flow rate is output. On the other hand, from a crank angle sensor 7 built-in a distributor 32, a pulse is output per every predetermined crankshaft angular displacement. These outputs are input to a control unit 71, in which a crank angle and an engine speed are calculated. Also, on the basis of the intake air flow rate and the engine speed thus calculated, a basic pulse width TP corresponding to a charging efficiency is derived.

At the throttle valve 40, a throttle angle sensor 1 detecting a throttle valve open angle is mounted. The output signal of this sensor is input to the control unit 71 to thereby detect the open angle of the throttle valve 40, a fully closed state thereof and an acceleration state or the like.

At the internal combustion engine 65, a coolant temperature sensor 3 for detecting a coolant temperature is mounted. An output signal of this sensor is input to the control unit 71, which in turn detects a warm-up condition, increases a fuel injection amount, corrects a spark ignition timing, controls ON/OFF state of a radiator fan 75 and sets a target speed upon idling.

An $O_2$ sensor 8 as an air/fuel ratio sensor is mounted on an exhaust pipe of the engine and adapted to output a signal depending upon an oxygen concentration of an exhaust gas. This signal is input to the control unit 71, which in turn adjusts fuel injection pulse widths for injectors 23-1 to 23-4 so that a mixture to be supplied to the engine will have a target air to fuel ratio (A/F).

4 denotes a neutral switch of a gear, 5 denotes a vehicle speed sensor, 30 denotes an ignitor, 31 denotes a spark ignition coil, 33 denotes a spark plug, 73 denotes a lighting system including a headlamps.

As shown in FIG. 2, the control unit 71 is constructed with a CPU 100 as an arithmetic device, a ROM 101 as a read-only memory, a RAM 102 as a memory to be read out and written in, a back-up RAM 111 which does not clear the storage content thereof even when an ignition switch is turned off, an electrically writable memory 112 (for example, P-ROM, EEP-ROM, flash ROM or the like, here is assumed as EEP-ROM), an interrupt controller 104, a timer 105, an input processing circuit 106 and an output processing circuit 107. These components are connected one another by a bus 108. The CPU 100 performs processes, based on the program stored in the ROM 101, on the basis of various information processed by the input processing circuit by using the RAM 102 and the back-up RAM 111 which can hold the storage content thereof even during OFF state of the ignition key 72. At this time, an interrupt process is performed occasionally in response to an interrupt command generated by an interrupt controller 104 on the basis of the information from the timer 105 and the input processing circuit 106.

A generation system will be explained. The alternator 51 is constructed with a rotor on the outer periphery of which an exciting coil 54 is wound like the conventional alternator, and a stator around which three-phase windings **53*a*, 53*b* and 53*c* are wound so as to oppose to the outer perithery of the rotor. The rotor is rotatingly driven in synchronism with the crankshaft 66 of the internal combustion engine 65. A rectifier circuit 55 formed by series-parallel connected six diodes, for example, is connected to the three-phase windings 53*a*, 53*b* and 53*c* of the alternator 51, so that a three phase alternating output of the alternator 51 is rectified and supplied to the vehicular battery 50 for charging the same. In the foregoing control unit 71, an alternator control program, for adjusting an output voltage of the alternator so that the battery voltage becomes close to a target generation voltage, is incorporated. An exciting coil driving circuit 56 (for example, transistor) for controlling a control amount of the exciting coil 54, namely a driving amount (driving current) for the exciting coil 54, is controlled in the following manner. Namely, the CPU 100 compares a voltage 50*a* of the battery 50 which is charged by a generated power of the alternator 51 and detected by a voltage detection unit, i.e. the input processing circuit 106, and a result of calculation of a target generation voltage calculated depending upon a coolant temperature representative of a driving condition of the internal combustion engine. Then, the CPU calculates a driving amount of the exciting coil 54 so that the voltage of the battery becomes close to the target voltage based on the comparison result, and outputs the drive signal from the alternator control terminal (CL terminal) 51*a* to the exciting coil driving circuit 56. The revolution speed of the internal combustion engine is controlled by an ISC valve driving amount which is derived by adding an electric load correction amount derived from the driving amount of the exciting coil and the driving condition to the driving amount of the ISC valve 41**.

The control apparatus of FIG. 2 controls respective actuators (the fuel injectors 23-1 to 23-4, ISC valve 41, exciting circuit driving circuit 56 and the like) on the basis of the values (namely, respective detection values of the driving condition of the internal combustion engine) of the output of various sensors taken by the input processing circuit.

Figure 3:
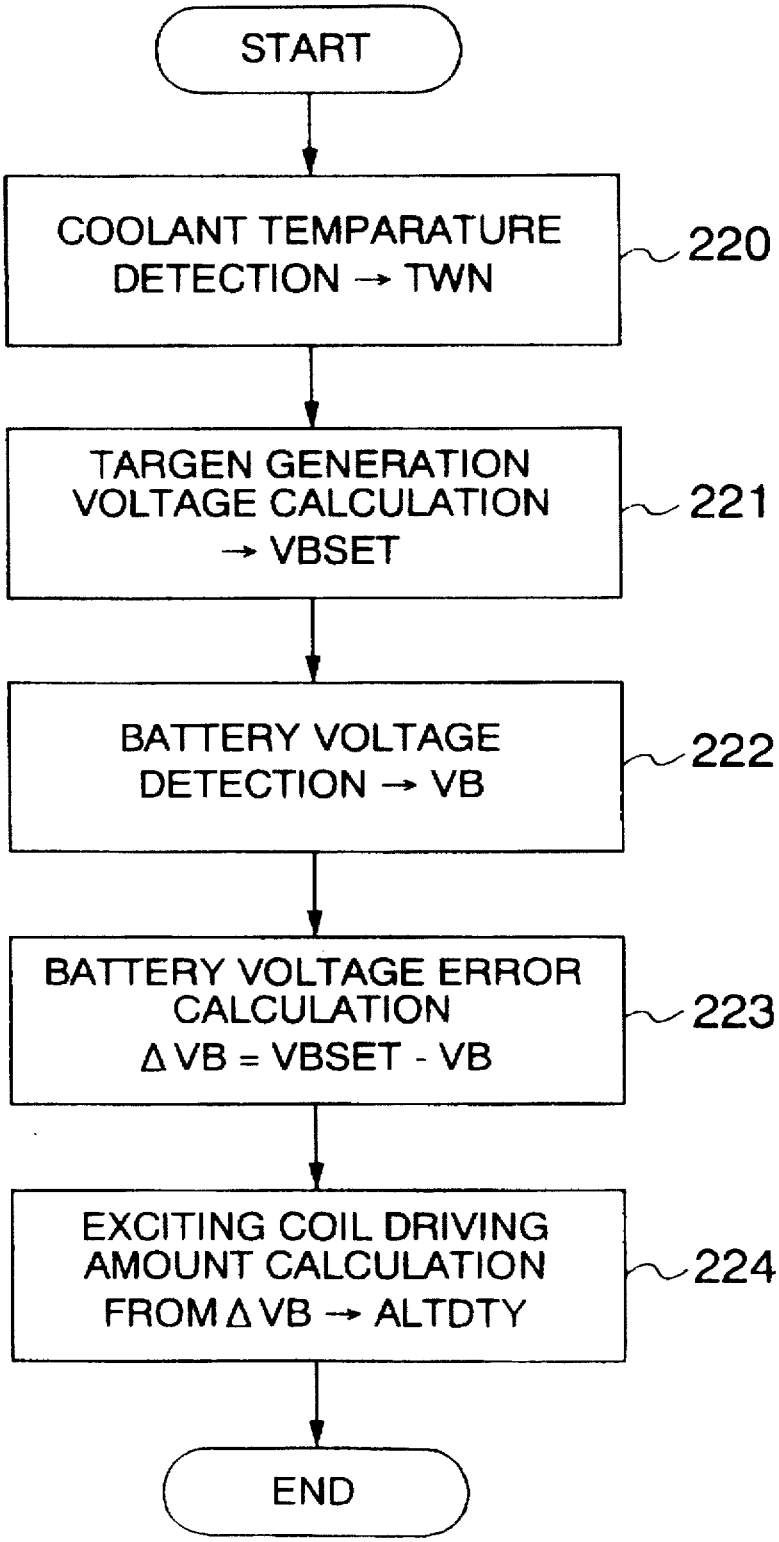
FIG. 3 is a flowchart showing a process for controlling a driving current amount to a exciting coil of a generator depending upon a driving condition.

Next, in the control apparatus shown in FIG. 2, one example of process for controlling the internal combustion engine depending upon the driving condition of the internal combustion engine will be explained with reference to FIG. 3. FIG. 3 is a flowchart showing a process for controlling a driving current amount for the exciting coil of the alternator depending upon the driving condition. Here, explanation will be given for the case where the output of the coolant temperature sensor 3, namely the detection value of the coolant temperature is employed as the driving condition. It should be noted that the process of FIG. 2 is executed by the CPU 100 on the basis of the program in the ROM 101.

At first, at step 220, the output signal of the coolant temperature sensor 3 is read via the input processing circuit 106 and the bus 108 to detect the coolant temperature TWN. Next, at step 221, with reference to a table in the ROM 101 showing a relationship between a coolant temperature TWN and a target generation voltage VBSET, a target generation voltage VBSET is calculated on the basis of the detected value of the coolant temperature TWN.

Next, at step 222, the battery voltage 50*a* from the battery 50 is read via the input processing circuit 106 and the bus 108 to detect a battery voltage VB. At step 223, a voltage error ΔVB (=VBSET−VB) of the battery voltage detection value VB versus the target generation voltage VBSET is calculated. At step 224, with reference to a table in the ROM 101 showing a relationship between the voltage error ΔVB and the driving amount of the exciting coil 54, a driving amount ALTDTY of the exciting coil 54 is derived. As the driving amount of the exciting coil, a duty ratio of the pulse width of the drive signal to the transistor 56 forming the exciting circuit driving circuit, for example, may be employed.

Accordingly, by applying the drive signal having the duty ratio according to the driving amount ALTDTY of the derived exciting coil, to the transistor 56 via the generator control terminal 51*a* from the output processing circuit 107, the exciting current to the exciting coil 54 is controlled so that the battery voltage VB is controlled to be equal to the target generation voltage VBSET.

Control of other actuators depending upon the driving condition is performed in the similar manner.

Figure 4:
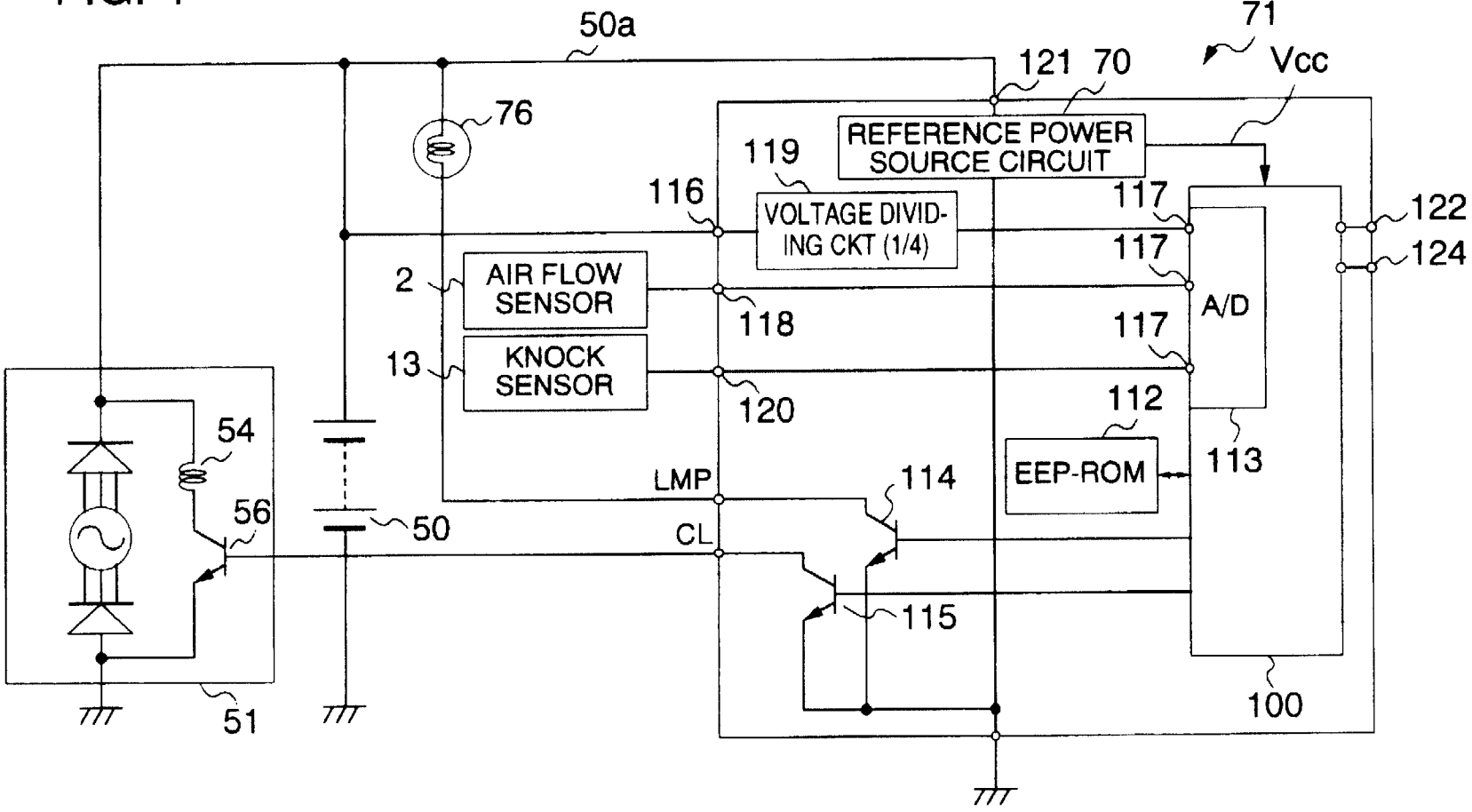
FIG. 4 is a block diagram showing the major part of the control apparatus of FIG. 2.

FIG. 4 is a block diagram showing the construction of the major part of the control apparatus of FIG. 2. FIG. 4 shows the condition where the control unit 71 is installed on the vehicle. As shown in FIG. 4, the control unit 71 includes a reference power source circuit 71 generating a reference voltage Vcc to be supplied to the control apparatus (control unit 71, various sensor and the like) on the basis of the battery voltage 50*a* from the vehicular battery 50. The control unit 71 includes a voltage dividing circuit 119 for lowering the battery voltage 50*a* through voltage division thereof so as to detect the battery voltage 50*a*. The voltage dividing circuit 119 is included in the input processing circuit 106. Also, the control unit 71 includes a transistor 115 amplifying the drive signal from the CPU 100 for controlling the driving current amount to the exciting coil 54 of the alternator and a transistor 114 amplifying the drive signal from the CPU 100 for driving a charge lamp 76. These transistors 114 and 115 are included in the output processing circuit 107. The control unit 71 includes terminals 116, 118, 120, LMP and CL. The output of the transistor 114 is applied to the charge lamp 76 through the terminal LMP, while the output of the transistor 115 is applied to the transistor 56 via the terminal CL. The terminal 116 is a terminal for inputting the battery voltage 50*a*. The terminal 118 is a terminal for inputting the output signal from the air flow sensor 2. The terminal 120 is a terminal for inputting an output signal of a knock sensor 13. While FIG. 4 shows only a part of various sensors shown in FIG. 2, the outputs of other sensors are input to the control unit 71 via the terminals of the control unit 71 in the same manner. Although the control unit 71 includes the ROM 101 and so forth as shown in FIG. 2, they are omitted in FIG. 4.

As shown in FIG. 4, outputs from various sensors, such as the air flow sensor 2, the throttle angle sensor 1, the coolant temperature sensor, the knock sensor 13 and so forth, are applied to the A/D converter 113 in the CPU 100 via the input processing circuit 106 and converted into digital data. Since the battery voltage 50*a* from the vehicular battery 50 is normally at a value of about 14.4 V, it is applied to the A/D converter 113 after voltage division by the voltage divider 119 for lowering down to the voltage value to be processed by the CPU 100. Typically, the battery voltage 50*a* is divided into one quarter by the voltage divider 119.

As set forth above, since the reference power source circuit 70 has fluctuation in value of the circuit elements (e.g. values of the resistor, capacitor, and the like) forming the same per the control system, namely per the vehicle, the reference voltage Vcc generated by the reference power source circuit 70 fluctuates per the control apparatus. If the reference voltage generated by such a reference power source circuit fluctuates per the control apparatus, the output values of the sensors and the output values of the A/D converter should also fluctuate The fluctuation of the output value of the A/D converter due to fluctuation of the circuit elements of the reference power source circuit is about ±5%.

Also, since the values of the circuit elements forming the A/D converter 100 in the CPU also fluctuates per the control apparatus, the output value of the A/D converter should also fluctuates per the control apparatus. The fluctuation of the output value of the A/D converter due to fluctuation of the circuit elements of the A/D converter is about ±0.05%.

Furthermore, the voltage divider circuit performing voltage division of the battery voltage also contains fluctuation of the values of the circuit elements forming the same per the control apparatus. Therefore, the output value of the voltage divider circuit should also fluctuates per the control apparatus. The fluctuation of the output value of the A/D converter due to fluctuation of the circuit elements of the voltage divider is about ±1%.

Accordingly, error should be caused in the output value of the voltage divider 119 and error should also be caused in the output value of the A/D converter 113 to make it impossible to accurately detect the output values of the respective sensors and the battery voltage VB, namely driving condition of the internal combustion engine. As a result, by failure of accurate control depending upon the driving condition of the internal combustion engine, degradation of fuel economy, lowering of engine driving performance and so forth should be caused.

Therefore, in this embodiment, in order to correct error of the output values (detection values of the driving condition) of the A/D converter 113 due to fluctuation in the reference power source circuit 70, the voltage divider circuit 119 and the A/D converter 113 per the control apparatus, correction data for correcting the detection value of the driving condition output from the A/D converter to a correct value (correct detection value of the driving condition) is derived in advance per each control apparatus and stored in the memory of the corresponding control apparatus. Then, the detection value of the driving condition from the A/D converter is corrected to the correct value on the basis of the correction data stored in the memory.

Figure 5:
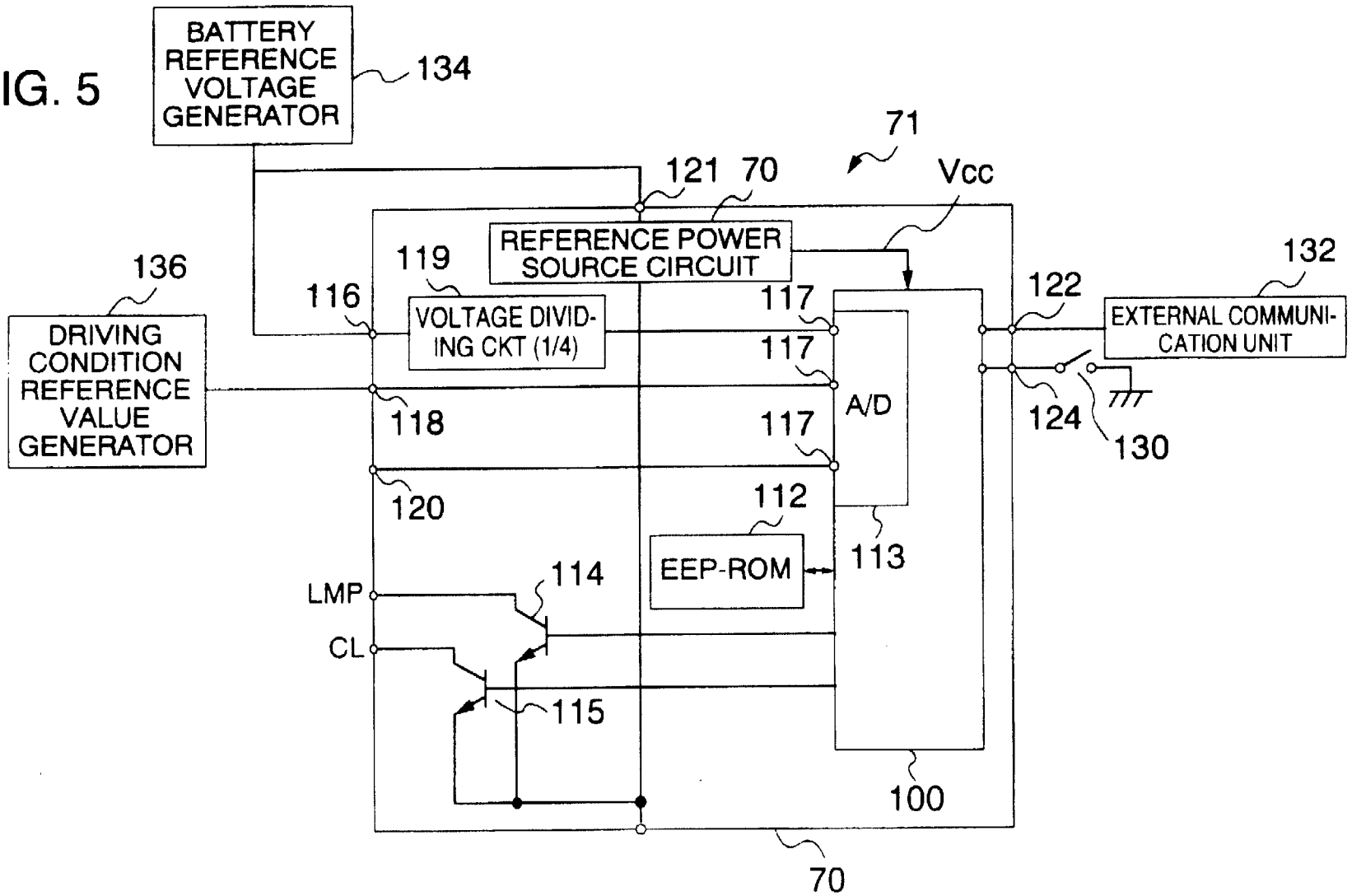
FIG. 5 is a illustration of a construction of the major part of a control unit for explaining a process for deriving correction data of a driving condition detection data and storing the same before installation of the control unit in FIG. 2 on the vehicle.

FIG. 5 is a block diagram showing the configuration of the major part of the control unit 71 for performing the process to derive such correction data, and shows a status of the control unit before installation on the vehicle. The CPU 100 has "a correction data setting mode" for performing a process to derive the correction data and a normal "internal combustion engine control mode" for controlling the internal combustion engine depending upon the driving condition. In order to perform the switching between these two modes, the control unit 71 has a switch 130 for commanding the switching between the "correction data setting mode" and the "internal combustion engine control mode", as shown in FIG. 5. One terminal of this switch 130 is grounded, and the other terminal thereof is connected to the CPU 100 via a terminal 124. When the switch 130 is turned ON, the terminal 124 is grounded, then the CPU 100 is switched into the "correction data setting mode", for example, and when the switch 120 is turned OFF, the CPU is switched into the "internal combustion engine control mode". Accordingly, after termination of the process in the "correction data setting mode", the switch 130 is turned OFF, and the control unit is installed with maintaining the OFF state of this switch.

It should be noted that, instead of providing the switch 124, an external communication unit 132 may be connected to a terminal 122 only when the CPU 100 is to be operated in the "correction data setting mode". Namely, upon placing the CPU 100 in the "correction data setting mode", the external communication unit 122 may be connected to the terminal 122 to apply a predetermined signal from the external communication unit 122 to the CPU 100 via the terminal 122 to place the CPU 100 in the "correction value setting mode".

A battery reference voltage generator 134 is connected to the terminals 121 and 116. Thus, the battery reference voltage (e.g. 14.4 V) is applied to the reference power source circuit 70 and the voltage dividing circuit 119. Also, a driving condition reference value generator 136 is connected to one of a plurality of terminals provided in the control unit 71 for inputting the outputs from the various sensors, for example, to the terminal 118 for inputting the output of the air flow sensor 2. The driving condition reference value generator 136 outputs a driving condition reference value OCref (for example, the predetermined voltage value, e.g. 4 V) as the reference value showing the driving condition. In such a condition, the process to derive the correction data is performed.

Figure 6:
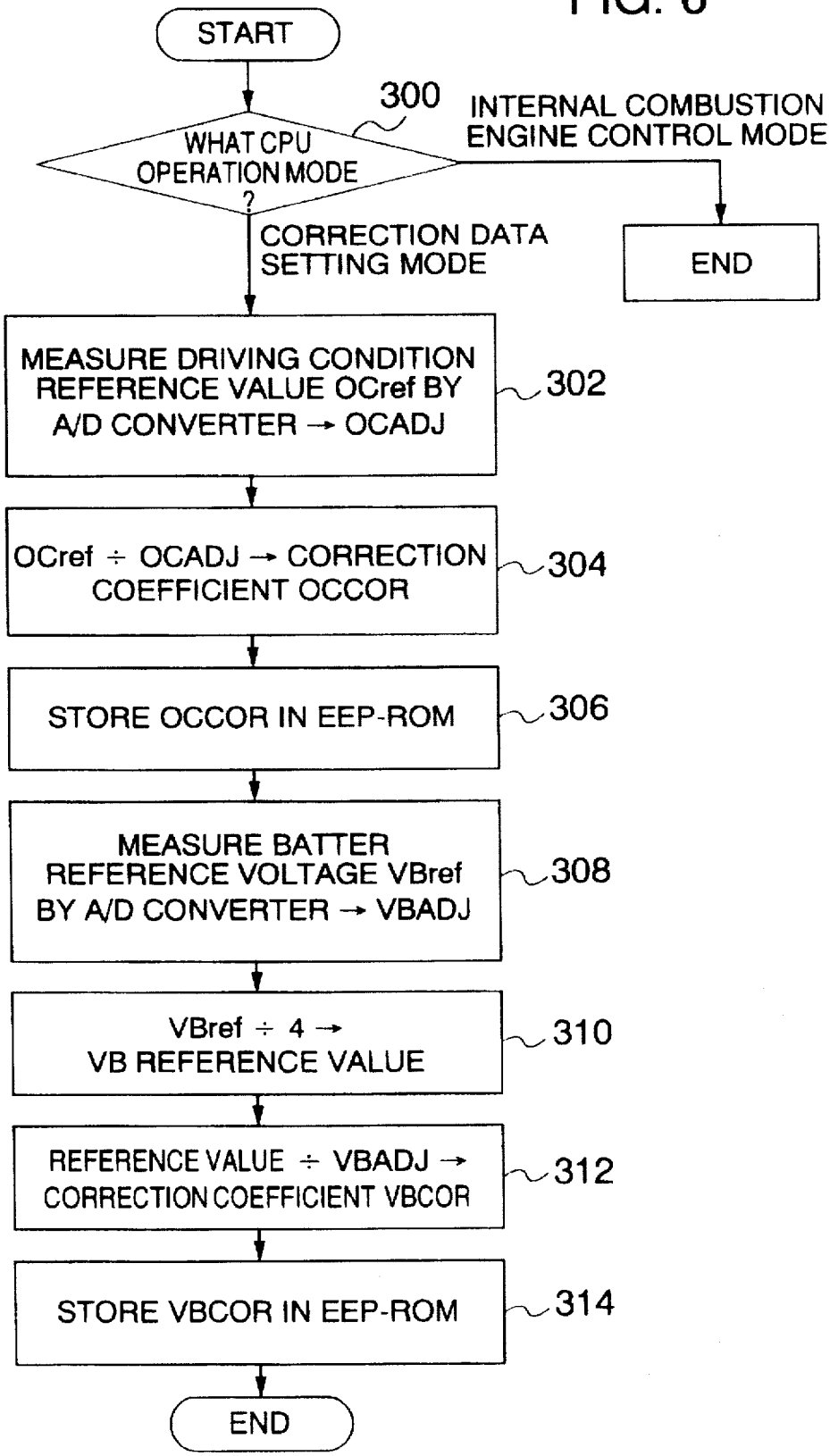
FIG. 6 is a flowchart for explaining the process for deriving a correction data of a driving condition detection value and a correction data of a battery voltage detection value.

FIG. 6 is a flowchart for explaining the process for deriving the correction data (correction coefficient, correction value or the like). This flowchart illustrates a process for deriving the correction data (correction coefficient, correction value or the like) with respect to the output value of the A/D converter 113 in the case where the output values from the various sensors are detected (measured) by the A/D converter 113 without passing through the voltage divider, and a process for deriving the correction data for the output value of the A/D converter 113 in the case where the battery voltage is detected via the voltage divider circuit 119 and the A/D converter 113. Here, explanation will be made for the case where the correction data is derived on the basis of the output of the air flow sensor 2. The processes shown in FIG. 6 and FIGS. 7 and 8 which will be discussed later, are executed by the CPU 100 on the basis of the program in the ROM 101.

At first, at step 300, it is determined whether a level at the terminal 124 of the control unit 71 is the ground level or not, namely, whether the operation mode of the CPU 100 is the "correction data setting mode" or the "internal combustion engine control mode". Namely, when the switch 130 is turned ON and the level of the terminal 124 is the grounding level, determination is made that the operation mode is the "correction value setting mode" and the process proceeds to step 302. On the other hand, when the switching 130 is turned OFF and the level of the terminal 124 is not the ground level, determination is made that the operation mode is the "internal combustion engine control mode" to terminate the process.

At step 302, the driving condition reference value OCref (4 V) from the driving condition reference value generator 136 is measured (detected) by the A/D converter 113 to obtain the A/D converted value (namely, the detected value or the measured value of the driving condition reference value) OVADJ (e.g. 3.2 V) of the driving condition reference value. Next, at step 304, a ratio between the A/D converted value OVADJ of the driving condition reference value and the correct A/D converted value OCref of the driving condition reference value stored in the RAM 102, for example, in advance (namely, an ideal (true) A/D converted value of the driving condition reference value derived arithmetically in the case where it is assumed that no error of reference power source circuit 70 and the A/D converter 113 is present, here 4 V) is derived. Namely, OCref÷OCADJ= correction coefficient OCCOR (here 4÷3.2=1.25) is obtained. Namely, this correction coefficient is the correction data for correcting the A/D converted value (detected value) OCAD value of the driving condition to the true A/D converted value (detection value) OCADrel of the driving condition.

Next, at step 306, the derived correction coefficient OCCOR is stored in the EEP-ROM 112.

The correction coefficient OCCOR thus derived can be used as the correction coefficient for other sensors other than the air flow sensor. The reason is that the A/D converter and the reference power source circuit 70 are used in common for the various sensors.

It should be noted that, in this embodiment, the correction data with respect to certain one sensor (namely certain one driving condition) is used as common correction data for all of the sensors (namely, all other driving conditions except for the battery voltage). However, it is also possible to individually derive the correction data (correction coefficients) with respect to respective kinds of sensors (namely, various driving conditions).

Upon shipping the control unit 71, the A/D converted value OCADJ of the driving condition reference value per se may be stored in the EEP-ROM 112 as the intermediate parameter. Then, after installation of the control unit 71 on the vehicle, the OCADJ may be processed by the similar step as the step 304 to derive the correction coefficient OCCOR by the CPU 100.

Next, the process for deriving the correction data with respect to the battery voltage detection value by the A/D converter 113, will be explained. At first, at step 308 after completion of step 306, the battery reference voltage (14.4 V) from the battery reference voltage generator 134 is divided (here divided into one quarter) by the voltage divider 119, and the divided voltage is measured (detected) by the A/D converter 113, thereby obtaining the A/D converted value (namely, the detection value or the measured value of the battery reference voltage) VBADJ of the battery reference voltage (e.g. 3.2 V). Next, at step 310, the correct A/D converted value (VB reference value) after voltage division of the battery reference voltage (namely, the arithmetically derived ideal (true) A/D converted value of the battery reference voltage in the case where it is assumed that no error is caused in the reference power source circuit 70, the voltage divider 119 and the A/D converter 113, here 14.4÷4=3.6 V) is derived.

Next, at step 312, a ratio between the A/D converted value VBADJ of the battery reference voltage and the VB reference value is obtained. Namely, VB reference value VBADJ=correction coefficient VBOCR (here, 3.6÷3.2=1.125) is obtained. Namely, the correction coefficient is the correction data for correcting the A/D converted value (detected value) VBAD value of the battery voltage 50*a* to the true A/D converted value (detected value) VBADrel) of the battery voltage.

Next, at step 314, the derived correction coefficient VBCOR is stored in the EEP-ROM 112.

It should be noted that, upon shifting of the control unit 71, the A/D converted value VBADJ of the battery reference voltage per se may be stored in the EEP-ROM 112 as the intermediate parameter. Then, after installation of the control unit 71 to the vehicle, VBADJ may be processed in the similar manner as the foregoing steps 310 and 312 to obtain the correction coefficient VBCOR by the CPU 100.

After storing the correction coefficient by the process shown in FIG. 6, the battery reference voltage generator 134, the driving condition reference value generator 136 (and the external communication unit) are removed away from the control unit 71. Subsequently, the control unit 71 is installed on the vehicle to establish connected condition as illustrated in FIG. 4. It should be noted that the switch 130 is in an OFF state in this case.

Figure 7:
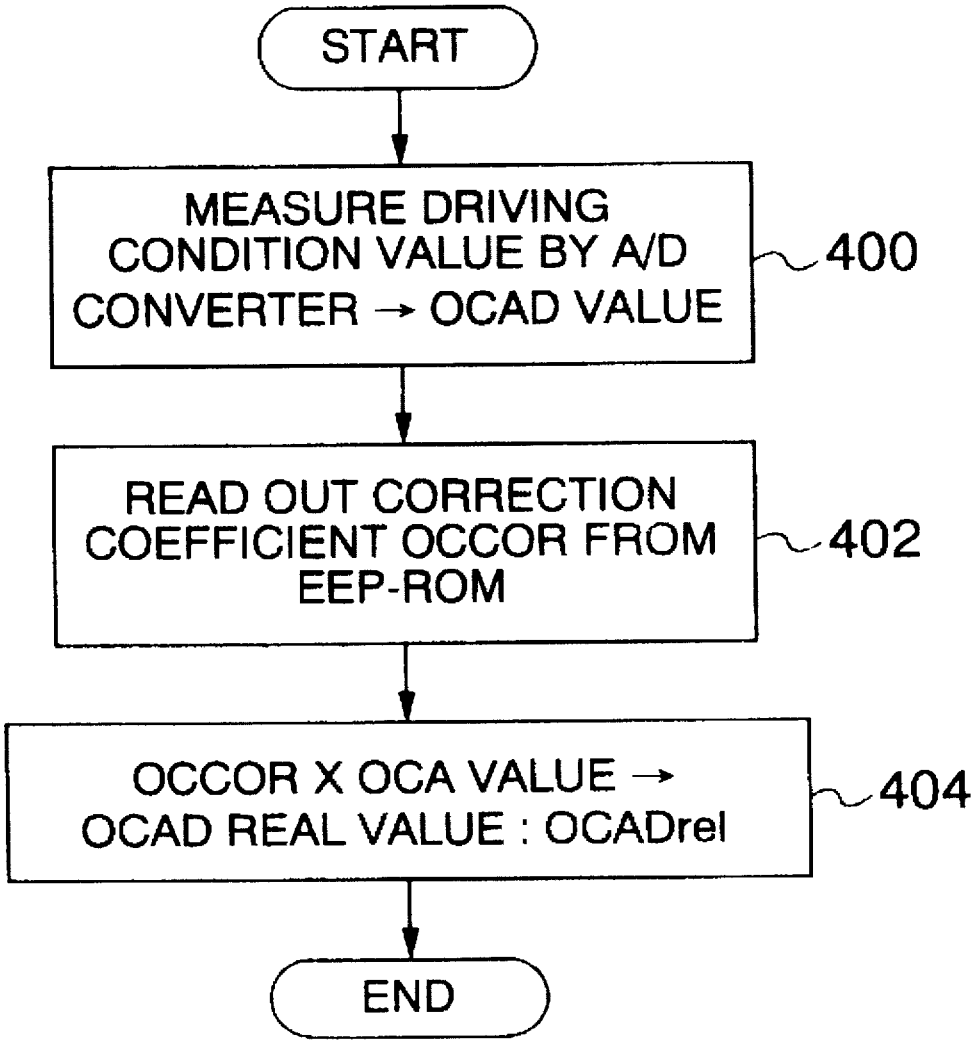
FIG. 7 is a flowchart for explaining a process for correcting the driving condition detection value on the basis of the correction data.

FIG. 7 is a flowchart for explaining the process for obtaining the output values (correct A/D converted values, namely correct driving condition detection values) of the correct A/D converter 113 by correcting the output values of the A/D converter 113, when the output values from the various sensors are detected (measured) by the A/D converter 113, on the basis of the correction data (correction coefficient) OCCOR obtained in the aforesaid manner.

At first, at step 400, A/D conversion is performed by taking the output (driving condition value) from the sensor (for example, the air flow sensor) in the A/D converter 113, to obtain the A/D converted value (detected value) OCAD of the driving condition. At step 402, the correction coefficient OCCOR is read out from the EEP-ROM 112. Next, at step 404, the A/D converted value (detected value) OCAD of the driving condition obtained at step 400 is multiplied with the correction coefficient OCCOR obtained at step 402. Then, the obtained multiplied value is taken as the true (correct) A/D converted value (detected value), OCAD true value (OCADrel) of the driving condition.

Thus, the true (correct) A/D converted value of the driving condition where the error of the output value (driving condition detected value) of the A/D converter 113 due to fluctuation of the reference power source circuit 70, the voltage divider 119 and the A/D converter 113 per control apparatus of the internal combustion engine, can be obtained. Accordingly, by controlling the internal combustion engine on the basis of the obtained correct A/D converted value of the driving condition, improvement of driving performance of the internal combustion engine and reduction of fuel consumption becomes possible. Furthermore, it becomes possible to improve precision in control of the internal combustion engine for preventing fluctuation of revolution -during an idling state.

Figure 8:
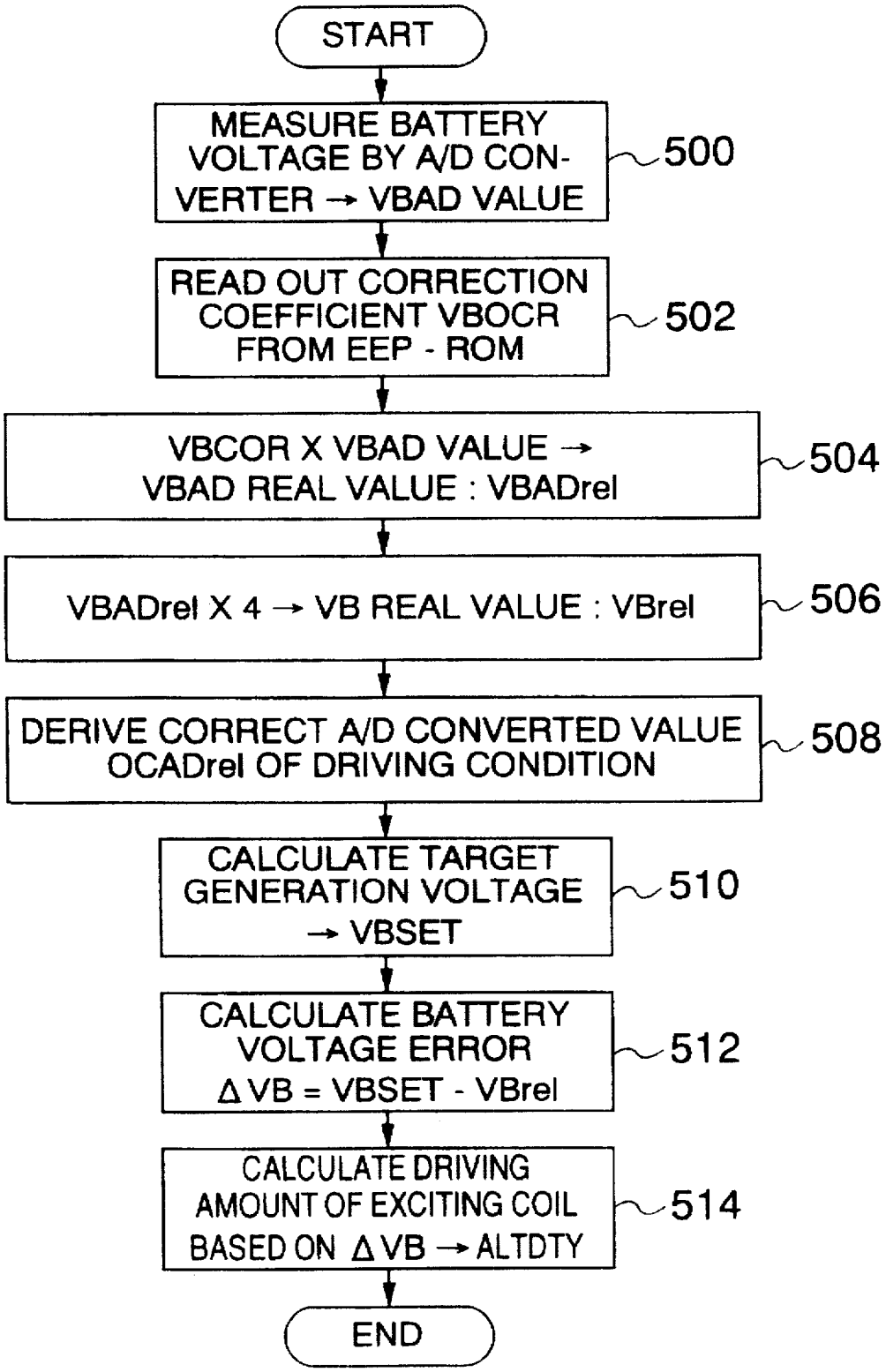
FIG. 8 is a flowchart for explaining the process for correcting a battery voltage detection value on the basis of the correction data.

FIG. 8 is a flowchart for explaining a process for correcting the detected value of the battery voltage on the basis of the correction data and controlling the battery voltage on the basis of the correct battery voltage having been corrected.

At first, at step 500, the battery voltage 50*a* of the battery 50 is taken into the A/D converter 113 via the voltage divider 119 to perform A/D conversion to obtain the A/D converted value (detected value) VBAD of the battery voltage. At step 502, the correction coefficient VBCOR is read out from the EEP-ROM 112. Next, at step 504, the A/D converted value (detected value) VBAD of the battery voltage obtained at step 500 is multiplied by the correction coefficient VBCOR obtained at step 502. The obtained multiplied value is taken as the true (correct) A/D converted value (detected value) of the battery voltage, VBCAD true value (VBADrel). Next, at step 506, by multiplying a dividing coefficient 4 in the correct A/D converted value VBADrel of the battery voltage, true (correct) battery voltage VBrel is obtained.

Thus, the correct battery voltage, in which the error of the output value (detected value of the driving condition) of the A/D converter 113 due to fluctuation of the reference power source circuit 70, the voltage divider 119 and the A/D converter 113, is corrected, can be obtained. For example, assuming that the reference power source voltage Vcc from the reference power source circuit 70 is in a precision of 5 V±0.25 V, namely having fluctuation of 0.5%, the detected value of the battery voltage should have error of 5%×4=20% due to the voltage dividing coefficient 4 of the voltage dividing circuit 119. However, by performing correction of the A/D converted value like this embodiment, it becomes possible to detect the battery voltage with high precision without causing any fluctuation.

Next, the driving current amount for the exciting coil of the alternator is controlled depending upon the driving condition on the basis of the thus obtained correct battery voltage and the detection value of the driving condition in the similar process as shown in FIG. 3. At step 508, by the similar process to FIG. 7, the correct A/D converted value OCADrel of the driving condition (here, the driving condition is the output of the coolant temperature sensor 3, namely the coolant temperature) is obtained. Next, at step 510, with reference to the table in the ROM 101 showing a relationship between the A/D converted value OCADrel and the target generation voltage VBSET, the target generation voltage VBSET is calculated on the basis of the OCADrel.

Next, at step 512, a voltage difference ΔVB (ΔVB=VBSET−VBrel) of the correct battery voltage VBrel obtained at step 506 versus the target generation voltage VBSET is calculated. At step 514, with reference to the table in the ROM 101 showing a relationship between the voltage difference ΔVB and the driving amount of the exciting coil 54, an exciting coil driving amount ALTDTY is obtained. The driving amount of the exciting coil, for example, may be the duty ratio of the pulse width of the driving signal to the transistor 56 forming the exciting circuit driving circuit, for example.

Accordingly, by applying the driving signal having the duty ratio according to the exciting coil driving amount ALTDTY thus obtained to the transistor 56 via the alternator control terminal 51*a* from the output processing circuit 107, the exciting current to the exciting coil 54 is controlled. Thus, the battery voltage VBrel is controlled to be equal to the target generation voltage VBSET.

Thus, according to the present invention, since the output (detection value of the driving condition) from the input circuit is corrected by using the correction data obtained in advance per control apparatus of the internal combustion engine, the error of the output value (detection value of the driving condition) of the A/D converter 113 due to fluctuation of respective circuit elements of the reference power source circuit 70, the voltage divider 119 and the A/D converter 113 per the control apparatus can be corrected. Accordingly, the internal combustion engine can be controlled on the basis of the corrected A/D converted values of the driving condition values of the sensor outputs, the battery voltage or the like. Furthermore, since the generation voltage of the alternator as one kind of the driving condition can be detected with higher precision, it becomes possible to control generation voltage and following ability of generation amount at high precision depending upon the driving condition of the internal combustion engine and the electric load condition. Furthermore, improvement of driving performance of the internal combustion engine or reduction of fuel consumption becomes possible. Furthermore, in order to perform suppression of fluctuation of revolution in an idling state, precision of control of the internal combustion engine can be improved. In the present invention, an error of the output value of the A/D converter 113 due to fluctuation of respective circuit elements of the reference power source circuit 70, the voltage divider 119 and the A/D converter 113 per the control apparatus of the engine, is not corrected by enhancing precision of the values of the circuit elements employing a method, such as laser trimming or the like, as in the prior art. Namely, in the present invention, the error of the output value of the A/D converter is corrected using the correction data obtained in advance per the control apparatus of the internal combustion engine and stored in the memory. Therefore, the output value of the A/D converter 113 can be detected with high precision at low cost.

The foregoing embodiment uses a ratio between one reference value of a certain driving condition (for example, air flow rate detected by the air flow sensor) and an output value obtained by applying the reference value to the input circuit at the corresponding driving condition (the A/D converted value (detected value) of the reference value of the driving condition), namely the correction coefficient as the correction data. However, it is possible to employ the following method as other method for deriving the correction data. Namely, a relationship between mutually different two reference values in a certain driving condition (for example, the air flow rate detected by the air flow sensor) and two output values obtained by applying the two reference values to the input circuit (the A/D converted values (detected values) of the reference value of the driving condition), is derived as a function, for example as a primary derivative function (a primary regression curve), and stored in the memory 112. Then, for detected value of the driving condition from the input circuit, the correct detected value of the driving condition may be obtained using the foregoing function.

Furthermore, as a further method for deriving the correction data, the following method may be employed. Namely, a difference between one reference value of a certain driving condition (for example, air flow rate detected by the air flow sensor) and an output value obtained by applying the reference value to the input value at the corresponding driving condition (the A/D converted value (detected value) of the reference value of the driving condition), can be taken as the correction data. In this case, by adding the difference (correction data) thus obtained to the A/D detected value of the driving condition, the correct A/D converted value may be obtained. Concerning the battery voltage, the corrected battery voltage can be obtained in the similar manner.

INDUSTRIAL APPLICABILITY

As set forth above, the control method and the control system for the internal combustion engine, according to the present invention are useful for the control apparatus which controls the internal combustion engine on the basis of the driving condition values, such as sensor outputs, battery voltage and so forth. Particularly, it is suitable to apply the present invention to the control apparatus which comprises the input circuit inputting the driving condition value and outputting the digital values thereof, and the reference power source circuit for generating reference voltage for operating the control apparatus on the basis of the battery voltage from the vehicular battery, wherein the circuit elements of the input circuit and the reference power source circuit having fluctuation.

We claim:

1. An apparatus for controlling an internal combustion engine for a vehicle comprising:

driving condition detecting means for detecting a driving condition of said internal combustion engine and outputting a driving condition value indicative of the driving condition;

an input circuit inputting a driving condition value from the driving condition value from said driving condition detecting means, detecting said driving condition value and outputting as a driving condition detection value;

a reference power source circuit generating a reference voltage for operating said control apparatus on the basis of a battery voltage from a battery;

memory means for storing a correction data for correcting an error of the driving condition detected value detected by said input circuit caused by at least one of an error of the reference voltage from said reference power source circuit and an error of the output of said input circuit;

correcting means for correcting the driving condition detected value from said input circuit with said correction data stored in said memory means to obtain a correct driving condition detected value; and means for controlling said internal combustion engine on the basis of the correct driving condition detected value thus obtained.

2. A control apparatus as set forth in claim 1, which further comprises:

means for obtaining said correction data; and means for storing the obtained correction data in said memory means.

3. A control apparatus as set forth in claim 2, which further comprises:

means for selectively placing said means for obtaining said correction data and said means for storing, in an operating condition.

4. A control apparatus as set forth in claim 2, wherein said means for obtaining said correction data includes means for deriving said correction data by comparing a driving condition detected value output from said input circuit by applying a reference value of the driving condition to said input circuit with said reference value of said driving condition, and deriving said correction data on the basis of a result of the comparison, wherein said reference value of the driving condition indicates the driving condition detected value detected by said input circuit by applying said reference value of said driving condition to said input circuit at least when no error is contained in the reference voltage from said reference power source circuit.

5. A control apparatus as set forth in claim 2, wherein said means for deriving said correction value includes means for comparing the driving condition detected value output from said input circuit by applying the reference value of the driving condition to said input circuit and said reference value of said driving condition, and p1means for deriving said correction data on the basis of a result of comparison of said comparing means, wherein p1said reference value of the driving condition indicates the driving condition detected value detected by said input circuit by applying said reference value of said driving condition to said input circuit at least when no error is contained in the reference voltage from said reference power source circuit.

6. A control apparatus as set forth in claim 5, wherein said input circuit includes an analog/digital converter converting the driving condition value from said driving condition detecting means into a digital value.

7. A control apparatus as set forth in claim 5, wherein said input circuit includes a voltage divider dividing the driving condition value from said driving condition detecting means at a predetermined ratio and an analog/digital converter converting the driving condition value from said voltage divider into a digital value.

8. A control apparatus as set forth in claim 4, wherein said means for deriving said correction value includes p1means for obtaining a ratio between the driving condition detected value output from said input circuit and said predetermined reference driving condition detected value, as said correction data.

9. A control apparatus as set forth in claim 1, said memory means is a memory which can be electrically written in.

10. A method for controlling an internal combustion engine for a vehicle in a control apparatus which includes:

p1driving condition detecting means for detecting a driving condition of said internal combustion engine and outputting a driving condition value indicative of the driving condition; and p1a control unit having an input circuit inputting a driving condition value from the driving condition value from said driving condition detecting means, detecting said driving condition value and outputting as the driving condition detection value, a reference power source circuit generating a reference voltage for operating said control apparatus on the basis of a battery voltage from a battery, and means for controlling said internal combustion engine on the basis of a driving condition detected value from said input circuit, wherein the control method by said control unit comprising the steps of:

p1a) storing a correction data for correction an error of said driving condition detected value detected by said input circuit on the basis of at least one of an error of said reference voltage from said reference power source circuit and an error of the output of said input circuit, in a memory means in said control unit;

p1b) obtaining a correct driving condition detected value by correcting said driving condition detected value from said input circuit with the correction data stored in said memory means; and p1c) controlling said internal combustion engine on the basis of the obtained correct driving condition detected value.

11. A control method as set forth in claim 10, which further comprises:

p1d) step of deriving said correction data; and p1e) step of storing said derived correction data in said memory means.

12. A control method as set forth in claim 11, wherein said step of deriving said correction data and said step of storing are performed before installing said control unit on the vehicle.

13. A control method as set forth in claim 11, wherein said step of deriving said correction data comprises:

p1step of comparing a driving condition detected value output from said input circuit by applying a reference value of the driving condition to said input circuit with said reference value of said driving condition, and driving said correction data on the basis of a result of the comparison, wherein p1said reference value of the driving condition indicates the driving condition detected value detected by said input circuit by applying said reference value of said driving condition to said input circuit at least when no error is contained in the reference voltage from said reference power source circuit.

14. A control method as set forth in claim 11, wherein said step of deriving said correction data comprises:

p1step of comparing the driving condition detected value output from said input circuit by applying a reference value of the driving condition to said input circuit and said reference value of said driving condition, and p1step of driving said correction data on the basis of a result of the comparison, wherein p1said reference value of the driving condition indicates the driving condition detected value detected by said input circuit by applying said reference value of said driving condition to said input circuit at least when no error is contained in the reference voltage from said reference power source circuit.

15. A control method as set forth in claim 14, which further comprises a step of converting the driving condition value from said driving condition detecting means into digital value by a digital/analog converter of said input circuit to output as said driving condition detected value.

16. A control method as set forth in claim 14, which further comprises a step of performing voltage division for said driving condition value from said driving condition detecting means at a predetermined ratio by a voltage divider circuit, and converting the output of said voltage divider circuit into digital value by an analog/digital converter for outputting as said driving condition detected value.

17. A control method as set forth in claim 13, wherein said step of deriving the correction data comprises a step of deriving a ratio between the driving condition detected value output from said input circuit and said predetermined reference driving condition detected value, and obtaining said ratio as said correction data.

18. A control method as set forth in claim 17, wherein said step of obtaining said correct driving condition detected value obtains the corrected driving condition detection value by multiplying the driving condition detected value from said input circuit by said correction data stored in said memory means.

19. A control method as set forth in claim 13, wherein said step of deriving said correction data comprises:

p1step of storing the driving condition detected value output from said input circuit in said memory means as an intermediate parameter of said correction data before installation of said control section on the vehicle; and p1step of deriving said correction data from said intermediate parameter stored in said memory means and said predetermined reference driving condition detected value after installation of said control section on the vehicle.

20. A control method as set forth in claim 10, wherein said step of storing in said memory means stores in said memory means which can be electrically written in.

* * * * *